US007409903B2

(12) United States Patent
Scharp

(10) Patent No.: US 7,409,903 B2
(45) Date of Patent: Aug. 12, 2008

(54) ONE-PIECE PISTON FOR AN INTERNAL COMBUSTION ENGINE

(75) Inventor: Rainer Scharp, Vaihingen (DE)

(73) Assignee: MAHLE GmbH, Stuttgart (DE)

( * ) Notice: Subject to any disclaimer, the term of this patent is extended or adjusted under 35 U.S.C. 154(b) by 147 days.

(21) Appl. No.: 10/574,749

(22) PCT Filed: Oct. 4, 2004

(86) PCT No.: PCT/DE2004/002214

§ 371 (c)(1),
(2), (4) Date: May 17, 2006

(87) PCT Pub. No.: WO2005/035961

PCT Pub. Date: Apr. 21, 2005

(65) Prior Publication Data

US 2007/0039460 A1 Feb. 22, 2007

(30) Foreign Application Priority Data

Oct. 6, 2003 (DE) ..... 103 46 819

(51) Int. Cl.
*F01B 31/08* (2006.01)

(52) U.S. Cl. ..... 92/186

(58) Field of Classification Search ..... 92/186; 123/41.35

See application file for complete search history.

(56) References Cited

U.S. PATENT DOCUMENTS

| | | | | |
|---|---|---|---|---|
| 3,221,722 | A * | 12/1965 | Bachle | 123/41.35 |
| 4,377,967 | A | 3/1983 | Pelizzoni | |
| 4,577,595 | A * | 3/1986 | Deutschmann et al. | 92/186 |
| 5,778,533 | A * | 7/1998 | Kemnitz | 92/186 |
| 6,032,619 | A * | 3/2000 | Zhu et al. | 123/41.35 |
| 6,634,278 | B2 * | 10/2003 | Bochart | 92/186 |
| 2002/0178910 | A1 * | 12/2002 | Keller et al. | 92/208 |

FOREIGN PATENT DOCUMENTS

| | | |
|---|---|---|
| DE | 252638 | 12/1987 |
| DE | 3643039 | 6/1988 |
| DE | 3733964 | 4/1989 |
| DE | 4039751 | 6/1992 |
| DE | 4124634 | 1/1993 |
| DE | 4137126 | 5/1993 |
| DE | 4336952 | 5/1994 |
| DE | 4430137 | 2/1996 |
| DE | 10132447 | 1/2003 |
| DE | 10306115 | 9/2004 |
| DE | 10358121 | 11/2004 |
| EP | 0799373 | 10/1997 |
| EP | 1185775 | 12/2000 |
| WO | WO 92/10659 | 6/1992 |
| WO | WO 00/04286 | 1/2000 |

* cited by examiner

*Primary Examiner*—Michael Leslie
(74) *Attorney, Agent, or Firm*—Collard & Roe, P.C.

(57) ABSTRACT

The invention relates to a one-piece piston (1) for an internal combustion engine comprising an annular cooling channel (6) which is arranged in the edge area of the piston head (4) and closed by a substantially cylindrical embodied in one-piece ring (18).

8 Claims, 4 Drawing Sheets

ONE-PIECE PISTON FOR AN INTERNAL COMBUSTION ENGINE

CROSS REFERENCE TO RELATED APPLICATIONS

Applicant claims priority under 35 U.S.C. §119 of German Application No. 103 46 819.6 filed Oct. 6, 2003. Applicant also claims priority under 35 U.S.C. §365 of PCT/DE2004/002214 filed Oct. 4, 2004. The international application under PCT article 21(2) was not published in English.

The invention relates to a one-part piston for an internal combustion engine, in accordance with the preamble of claim 1.

A multi-part cooled piston having a cooling channel disposed in the edge region of the piston crown is known from the Offenlegungsschrift DE 40 39 751 A1, which is covered with a sheet-metal ring essentially configured like a plate spring. This sheet-metal ring is configured in one part and therefore can be assembled on the piston without problems, because the piston is structured in two parts. In this connection, it is necessary to first assemble the sheet-metal ring on the upper piston part, before the latter is connected with the lower piston part.

A one-part cooling channel piston having a cooling channel disposed in the edge region of the piston crown is known from the European patent EP 0 799 373 B1, which is also closed off with a cover ring configured like a plate spring. It is disadvantageous in this connection that this cover ring must be configured in two parts, in order to be able to be assembled. During assembly, each of the two ring halves in the shape of a semi-circle is individually introduced into corresponding supports on the piston head, in the biased state.

Proceeding from this, the invention is based on the problem of creating a cooling channel cover for a one-part piston of an internal combustion engine, which is easy to install.

The problem is solved with the characteristics contained in the characterizing part of the main claim. Practical embodiments of the invention are the object of the dependent claims.

An exemplary embodiment of the invention will be described in the following, using the drawings. These show FIG. 1 a piston for an internal combustion engine, having a cooling channel that is closed off by a ring that essentially has a cylinder shape, according to the invention, represented in a sectional diagram that consists of two halves, which diagram shows two longitudinal sections of the piston offset by 90°, FIG. 2 a section of the piston along the line A-A in FIG. 1, FIG. 3 a partial section of the piston along the line C-C in FIG. 2, which shows an oil feed pipe for the introduction of cooling oil into the cooling channel, FIG. 4 a partial section of the piston along the line B-B in FIG. 2 that shows the oil feed pipe snapped into the ring, FIG. 5 an enlarged representation of the region "X" in FIG. 4, which shows the snap-in connection between the ring and the oil feed pipe, FIG. 6 a top view of the ring with the oil feed pipe, and FIG. 7 a perspective representation of the ring with the oil feed pipe.

Figure 1:
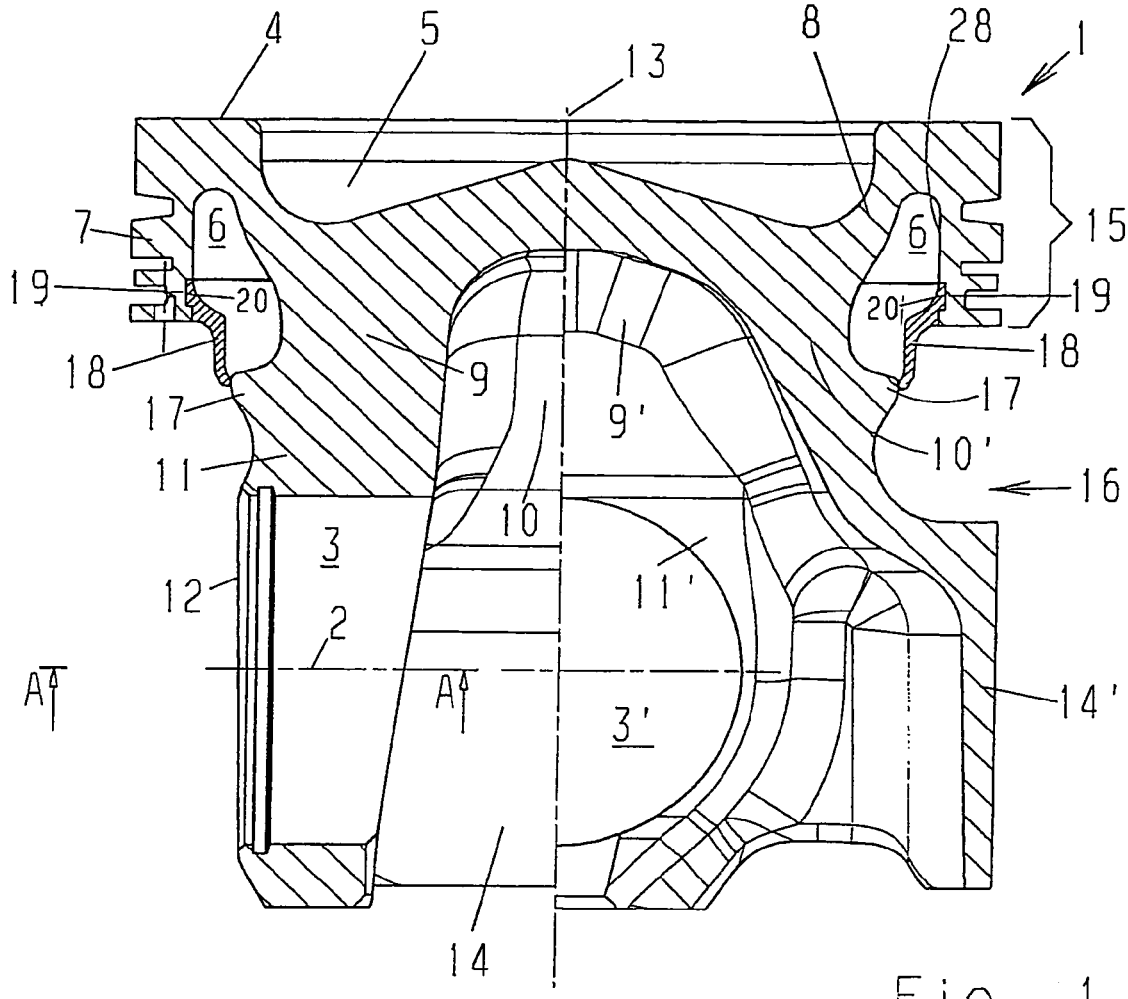
Figure 2:
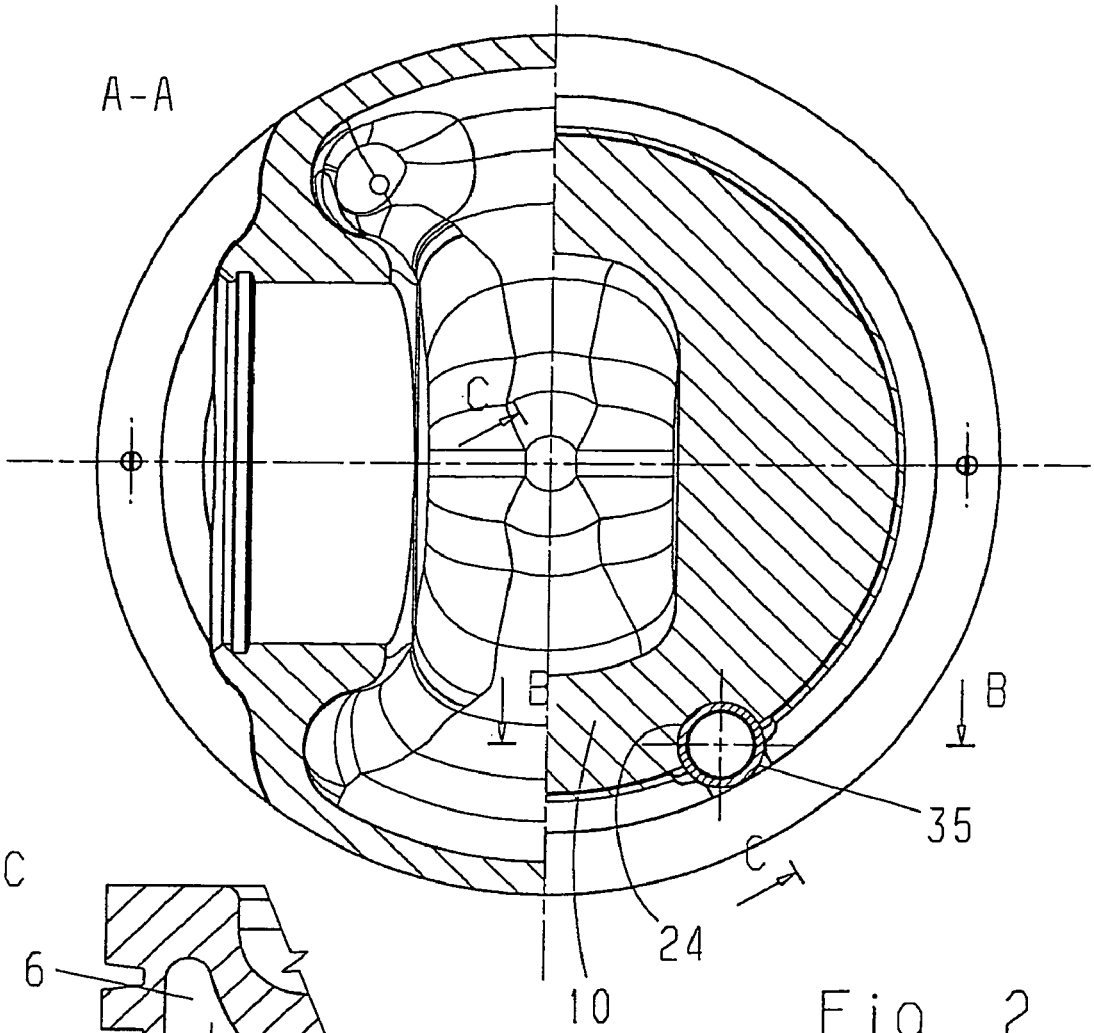

FIG. 1 shows a piston 1 for an internal combustion engine, configured in one piece, in a sectional diagram that consists of two halves, of which the left half shows a section of the piston 1 along a longitudinal axis 2 of a pin bore 3, and the right half shows a longitudinal section of the piston 1 offset by 90° relative to the former. The piston 1 is made of steel and has a combustion chamber bowl 5 in the region of the piston crown 4. In the radially outer region of the piston crown 4, a cooling channel 6 that runs around the circumference is disposed, the radially outer delimitation of which is formed by a ring wall 7 that is molded onto the piston crown 4, and the radially inner delimitation of which is formed partly by a ring rib 8, partly by a pin boss support 9, 9', and partly by a skirt connection 10, 10'. The ring wall 7 serves as a piston ring carrier in this connection.

Above the pin boss supports 9, 9', one pin boss 11, 11' with a pin bore 3, 3', in each instance, are each molded onto the piston crown 4. The faces 12 of the pin bosses 11, 11' are disposed set back relative to the ring wall 7, in the direction of the piston longitudinal axis 13. The pin bosses 11, 11' are connected with one another by way of skirt elements 14, 14', which are each molded onto the piston crown 4 by way of a shaft connection 10, 10'. Between the skirt elements 14, 14' and the region 15 of the piston 1 on the piston crown side, the latter has recesses 16.

On the pin boss 11, 11', and on the shaft connection 10, 10' of the piston 1, respectively, a circumferential, nose-shaped projection 17 is affixed, the purpose of which consists in serving as a contact surface for an essentially cylindrical, one-part ring 18, by which the cooling channel 6 is closed off. The ring 18 can consist of plastic or of metal. On the inside 28 facing the piston longitudinal axis 13, the ring wall 7 has a circumferential groove 19, into which a collar 20 molded onto the outside of the ring 18 can be set, which collar is also circumferential and disposed on the piston crown side, thereby making it possible to attach the ring 18 on the inside of the ring wall 7. As is particularly evident in FIGS. 6 and 7, the ring 18 has a gap 22.

The assembly of the ring 18 can take place in simple manner, in that it is bent open and laid into the region of the piston 1 between ring wall 7 and skirt elements 14, 14'. Subsequent to this, the ring 18 is pressed together, so that its radius becomes smaller, whereby the lower edge of the ring 18, on the skirt side, comes to rest against the projection 17. Because the upper edge of the ring 18, on the piston crown side, is still pressed inward a little more, it is subsequently possible to push the ring into the cooling channel 6 from below, so far that its collar 20 snaps into the groove 19 on the inside 28 of the ring wall 7, to fix the ring 18 in place.

An oil feed pipe 35 can be introduced into the gap 22, which consists of a funnel 21 with a pipe-shaped upper part 27, and which spreads the ring 18 when it is introduced. In this way, as particularly shown in FIGS. 4 and 5, it is reliably assured that the collar 20 of the ring 18 remains on the inside of the ring wall 7 even during fast back and forth movements of the piston 1 in the groove 19. The oil feed pipe 35 can consist of plastic or of metal.

Figure 3:
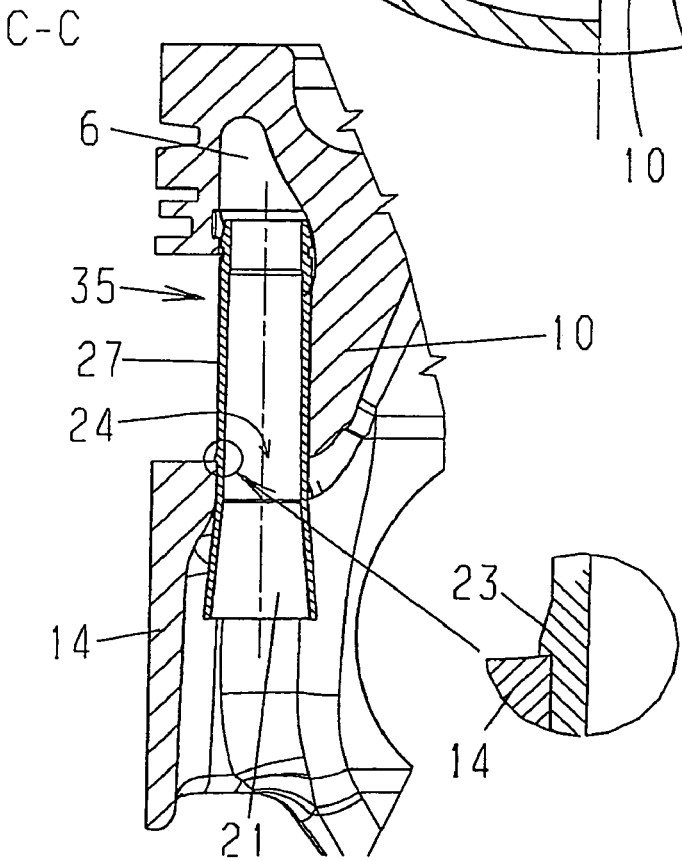
Figure 4:
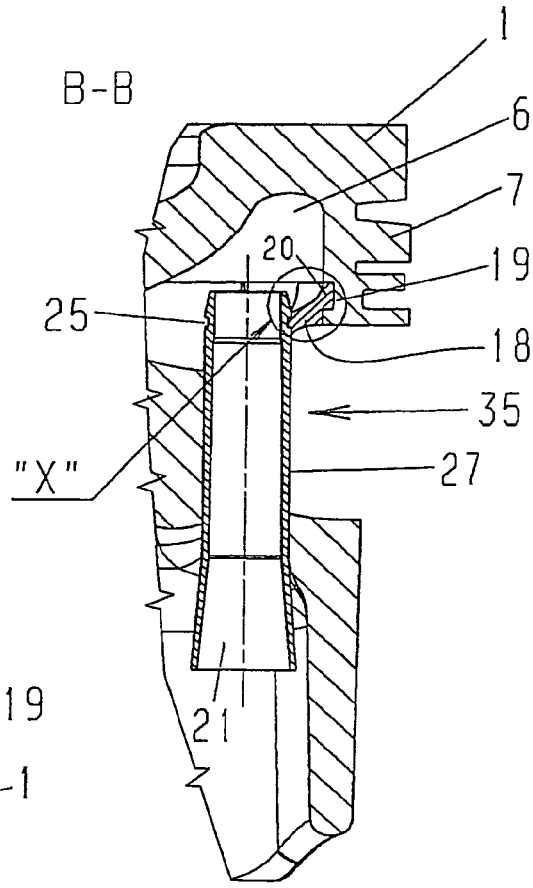

The oil feed pipe 35, as shown in FIG. 3, is attached to the piston 1, in that a nose 23 affixed on the upper part 27 comes to rest on the upper edge of an opening 24 made close to the skirt 14, 14', after the oil feed pipe 35 has been introduced into the opening 24. Furthermore, the upper part 27, as FIGS. 4, 5, and 7 show, has a circumferential groove 25 on its outside facing the piston crown, into which groove projections 26, 26' molded onto the inside of the ring 18 at its joints 29 and 30 snap when the oil feed pipe 35 is introduced into the opening 24, thereby attaching the oil feed pipe 35 on the ring 18.

Figure 5:
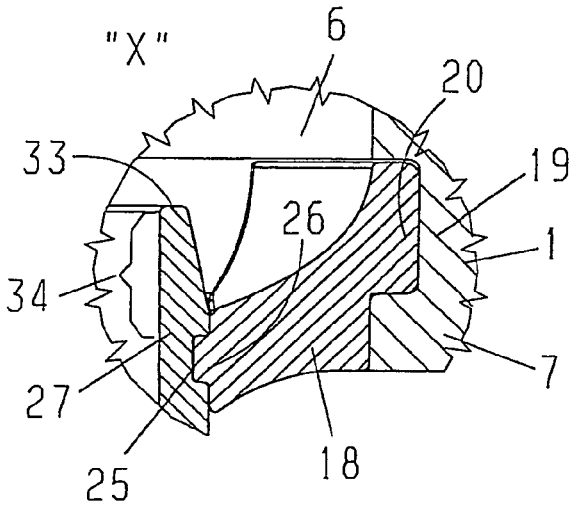
Figure 6:
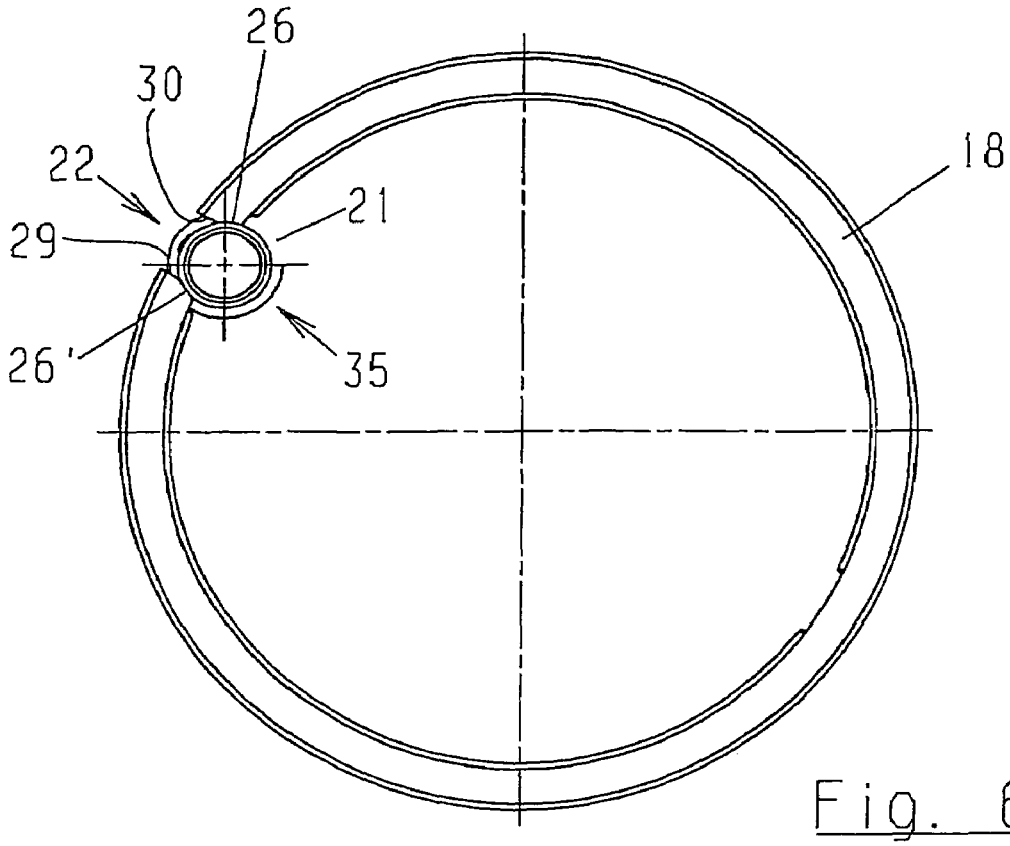
Figure 7:
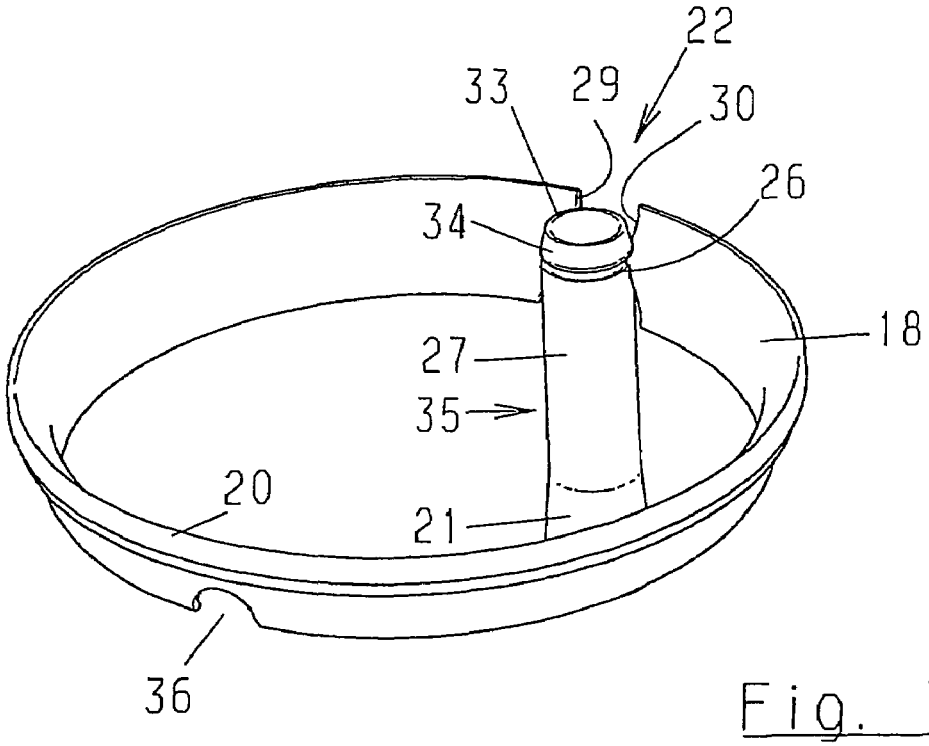

In this connection, the groove 25 has a specific distance from the face 33 of the upper part 27 on the piston crown side, which is sufficient so that, as shown in FIGS. 5 and 7, an excess length 34 of the upper part 27 results, so that the oil introduced into the cooling channel 6 does not immediately flow out of the cooling channel 6 again, through the upper part 27, and instead, is passed around the excess length 34 into the lower region of the cooling channel 6. The cooling oil can then flow off by way of an opening 36 (FIG. 7) affixed laterally on the ring 18.

REFERENCE SYMBOL LIST

1 piston
2 longitudinal axis
3 3' pin bore
4 piston crown
5 combustion chamber bowl
6 cooling channel
7 ring wall
8 ring rib
9 9' pin boss support
10, 10' skirt connection
11, 11' pin boss
12 face of the pin boss 11, 11'
13 piston longitudinal axis
14, 14' skirt element
15 region of the piston 1 on the piston crown side
16 recess
17 projection
18 ring
19 groove
20 collar
21 funnel
22 gap
23 nose
24 opening
25 groove
26, 26' projection
27 upper part of the oil feed pipe 35
28 inside of the ring wall 7
29, 30 joints of the ring 18
33 face of the upper part 27
34 excess length of the upper part 27
35 oil feed pipe
36 opening of the ring 18

The invention claimed is:

1. A one-part piston for an internal combustion engine, comprising:

a piston crown, two pin boss supports molded onto the piston crown for one pin boss each, wherein the pin boss supports and the faces of the pin bosses are disposed set back relative to a radially outer edge of the piston crown, in a direction of the piston longitudinal axis;

two skirt elements that connect the pin bosses, said skirt elements being connected with the piston crown by way of one skirt connection each, wherein recesses are molded into the skirt connections between the skirt elements and the piston crown;

a ring-shaped cooling channel disposed in an edge region of the piston crown, a radially outer delimitation of which is formed by a ring wall molded onto the piston crown, and a radially inner delimitation of which is formed partly by the pin boss supports and partly by the skirt connections;

a projection that runs around the circumference and is partly molded onto the pin boss supports and partly onto the skirt connections, and is nose-shaped in cross-section;

a ring having an essentially cylindrical shape and closing off the cooling channel, said ring having an axially oriented continuous gap forming two joint ends, said ring having a circumferential collar disposed on its outside for closing the cooling channel, said collar forming a snap-in connection with a circumferential groove molded into an inside of the ring wall, wherein the ring makes contact on the projection; and an axially oriented bore made in one of the skirt connections, into which an oil feed pipe is introduced, which pipe opens into the cooling channel, with its upper part, in the region of the ring, wherein the joint ends of the ring make contact with an upper part of the oil feed pipe.

2. The one-part piston for an internal combustion engine according to claim 1, wherein the upper part of the oil feed pipe has a circumferential groove on its outside, close to its face on the piston crown side, with which groove projections on the joints of the ring form snap-in connections after the oil feed ring is introduced into the bore.

3. The one-part piston for an internal combustion engine according to claim 2, wherein the groove is disposed at a distance from the face of the upper part, so that an excess length of the upper part above the ring results.

4. The one-part piston for an internal combustion engine according to claim 1, wherein the upper part has a nose in a center region of its outside, said nose resting on an upper edge of the bore after the oil feed pipe has been introduced into the bore.

5. The one-part piston for an internal combustion engine according to claim 1, wherein the oil feed pipe consists of metal.

6. The one-part piston for an internal combustion engine according to claim 1, wherein the oil feed pipe consists of a heat-resistant plastic.

7. The one-part piston for an internal combustion engine, according to claim 1, wherein the ring consists of metal.

8. The one-part piston for an internal combustion engine according to claim 1, wherein the ring consists of a heat-resistant plastic.

* * * * *